United States Patent [19]

Richardson

[11] 4,451,950

[45] Jun. 5, 1984

[54] LONG-SPAN BRIDGES

[75] Inventor: John R. Richardson, Kingston on Thames, England

[73] Assignee: NMI Limited, Feltham, England

[21] Appl. No.: 335,127

[22] Filed: Dec. 29, 1981

[30] Foreign Application Priority Data

Jan. 8, 1981 [GB] United Kingdom ..... 8100448

[51] Int. Cl.[3] ..... E01D 11/00; E01D 17/00

[52] U.S. Cl. ..... 14/18; 14/1; 14/73

[58] Field of Search ..... 14/18, 1, 73, 19–22

[56] References Cited

U.S. PATENT DOCUMENTS

| | | | |
|---|---|---|---|
| 629,935 | 8/1899 | Sturgis | 14/18 |
| 1,895,734 | 1/1933 | Rush . | |
| 2,333,391 | 11/1943 | Robinson | 14/18 |
| 2,642,598 | 6/1953 | Beretta | 14/18 |
| 3,211,110 | 10/1965 | Pierson | 14/18 X |
| 3,406,616 | 10/1968 | McLean | 404/1 |

FOREIGN PATENT DOCUMENTS

| | | |
|---|---|---|
| 1098024 | 1/1961 | Fed. Rep. of Germany . |
| 1223866 | 9/1966 | Fed. Rep. of Germany . |
| 2919318 | 12/1980 | Fed. Rep. of Germany . |
| 1539155 | 9/1968 | France . |
| 1120496 | 7/1968 | United Kingdom . |

OTHER PUBLICATIONS

"Tubular Arches Support Water Pipelines", from Acier-Stahl-Steel, vol. 36, Mar. 1971, p. 140.

*Primary Examiner*—Ernest R. Purser
*Assistant Examiner*—Mark J. DelSignore
*Attorney, Agent, or Firm*—Flynn, Thiel, Boutell & Tanis

[57] ABSTRACT

A suspension bridge has a first deck supported from a pair of suspension cables by hangers and a second deck independently supported from a pair of suspension cables by hangers. The two parallel decks are separated by a gap whose width is not less than that of either of the decks and is preferably three or more times the width of a deck. The decks are joined at intervals along their length by stiff transverse girders 22 and intervening diagonal shear braces so that the two decks behave essentially as a single rigid body in regard to torsional movement. This results in very high aerodynamic damping of both torsional and bending modes of oscillation.

11 Claims, 3 Drawing Figures

LONG-SPAN BRIDGES

FIELD OF THE INVENTION

The present invention relates to long-span bridges and more particularly, is concerned with the problem of aerodynamically-induced instability of the deck of such a bridge in high winds.

BACKGROUND OF THE INVENTION

For long spans it is usual to use a suspended structure in which the weight is carried by cables extending between towers at the ends of the main span or spans and the deck itself is primarily designed to give stiffness rather than strength. Similar considerations apply to cable-stayed structures in which cables for supporting the deck are connected directly between the deck and supporting towers at the end of the span. In these designs, and indeed in any bridge design in which the deck is not part of a substantially rigid structure but is free to twist about its longitudinal axis, it has been known for many years that with high winds transverse to the span, aerodynamically-induced instability could arise. This instability might be "flutter", that is to say torsional oscillations of the deck which increase with time, or "divergence", that is a twist deflection which increases exponentially. In either case distortion of the bridge could occur.

To minimize the danger of such instability occuring, or to raise the wind speed at which it will occur above the maximum which can be expected at the site of the bridge, it has been usual to provide extra torsional stiffness in the deck. Stiffening by means of vertical girders at the edges of the deck is not usually sufficient and has therefore been supplemeted by a transverse truss below the deck. In more recent designs the stiffening has been effected by a streamlined steel torsion box of which the upper surface carries the traffic. It has also been proposed in U.K. Patent Specification No. 1,523,811 to reduce the aerodynamic effects by perforating or slotting the deck, thereby enabling it to be supported at the centre of transverse beams which are suspended from cables more widely spaced than normal for the width of the deck to increase the torsional stiffness.

SUMMARY OF THE INVENTION

In accordance with the present invention there is provided a long-span bridge in which the deck is supported by a span with some freedom to twist about its longitudinal axis, characterized in that the bridge is composed of two or more parallel spans having independently-supported decks, each pair of spans being transversely spaced by a distance greater than the width of either deck and joined at intervals along their length by stiff transverse beams which couple the two decks so that they behave in torsion as a single substantially rigid body.

Normally the bridge will be designed with two parallel spans but the invention provides for increasing the traffic capacity by building an additional span or spans, parallel to the first two and interconnecting the additional span or spans with the existing structure.

Preferably the transverse beams are connected at their ends to the decks and they preferably extend under the two decks. However, in a suspension bridge in which each deck is suspended from its own pair of transversely-spaced cables, the transverse beams could be arranged to connect all four cables.

The addition of diagonal shear bracing between the transverse beams greatly increases the horizontal bending stiffness of the bridge and thus improves the resistance to drag forces.

In the design in accordance with the invention the decks are directly supported from their own suspension cables or other supports and the transverse beams therefore normally carry no load except their own weight. The necessary stiffness in the beams can be achieved with a structure whose weight is only a few percent of the total weight of the bridge superstructure.

The separation of the two decks, which is preferably by a gap of three or more deck widths, results in very high aerodynamic damping of both torsional and bending modes of oscillation. The wind speed at which divergence will occur increases with the spacing between the decks and can thus be made as high as required.

BRIEF DESCRIPTION OF THE DRAWINGS

The invention will now be described in more detail with the aid of an example illustrated in the accompanying drawings, in which.

DETAILED DESCRIPTION

Figure 3:
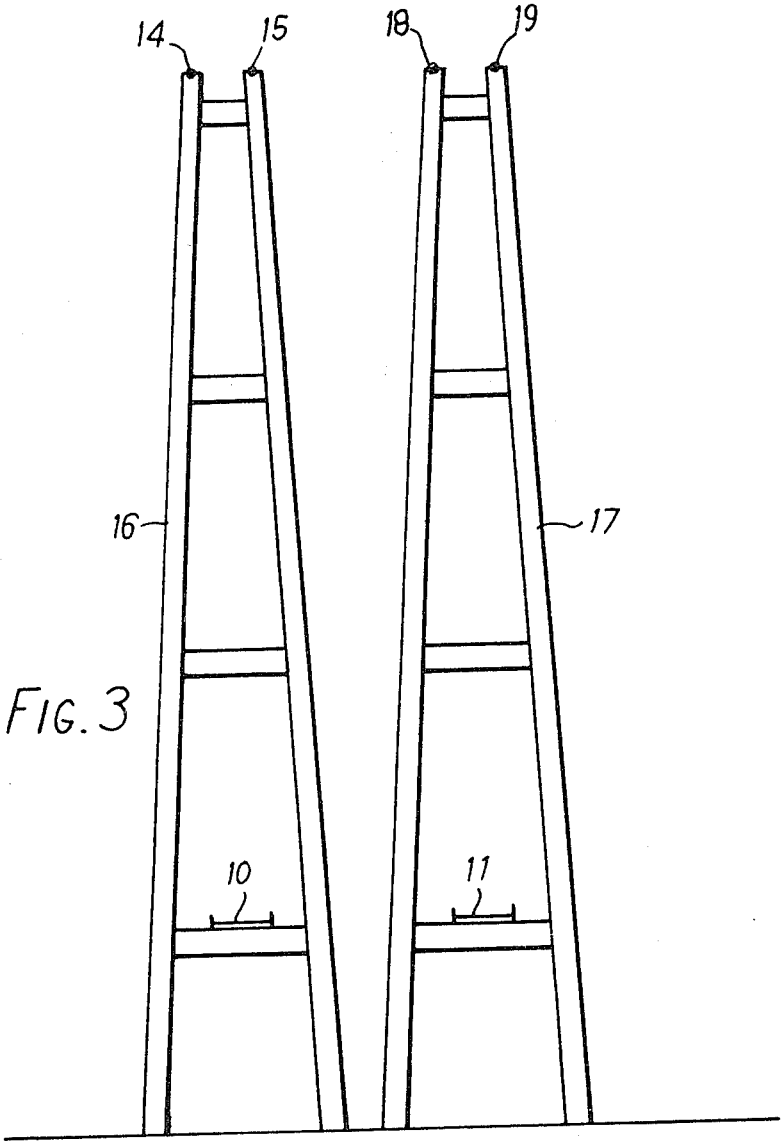
FIG. 3 is a schematic and elevation of the towers at one end of the span of the suspension bridge of FIGS. 1 and 2.

As seen in the drawings, the bridge comprises two decks or carriageways 10 and 11 which run parallel to one another and are of the same structure and dimensions. The deck 10 is carried by vertical hangers 12 and 13 attached to respective suspension cables 14 and 15. The cables 14 and 15, which are spaced by the width of the deck 10, pass over towers at the ends of the span and are anchored in conventional manner. One of the end towers 16 is seen in FIG. 3 and the end of the deck 10 is attached to the tower 16. A second pair of end towers, of which one is seen at 17 in FIG. 3, supports the deck 11 by way of cables 18 and 19 and hangers 20 and 21 attached to the cables 18 and 19, respectively.

The structure described so far consists of two independent suspension bridges of conventional design built side by side. The two decks 10 and 11 are independently supported from their own pairs of transversely-spaced suspension cables. The two parallel decks are separated by a gap whose width is not less than the width of either of the decks and is preferably three or more times that width. Bridging this gap are a series of transverse girders 22 at intervals along the length of the bridge, and diagonal shear braces 23.

Figure 1:
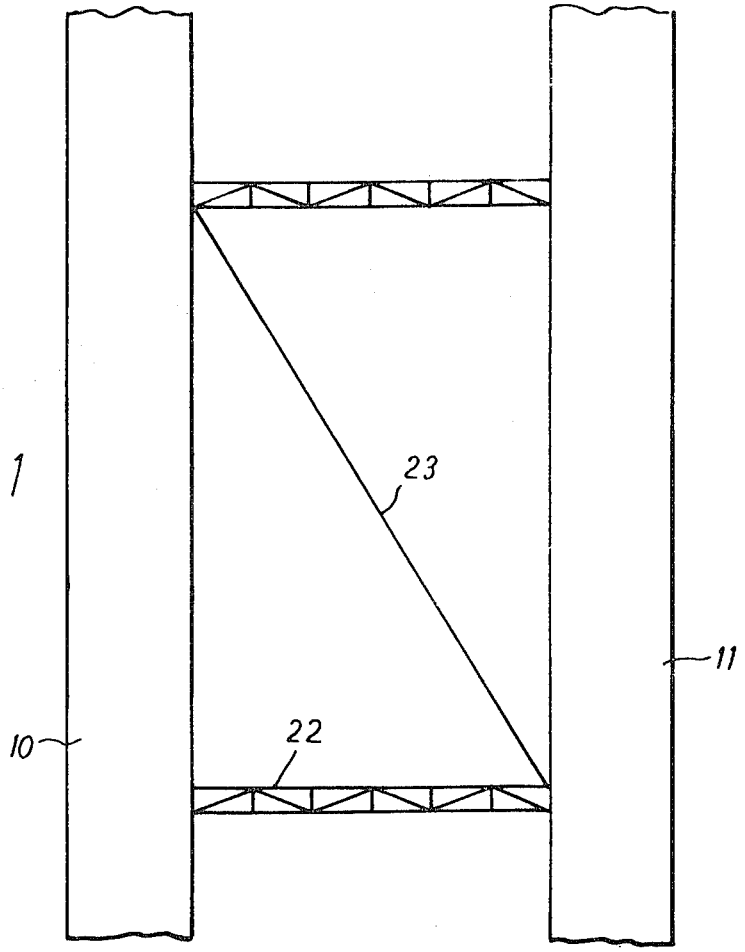
FIG. 1 is a diagrammatic plan view of part of a twin suspension bridge in accordance with the invention.
Figure 2:
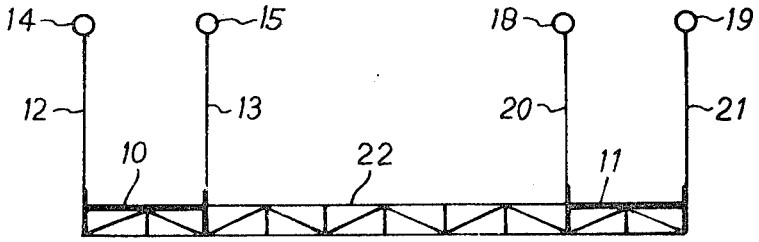
FIG. 2 is schematic transverse section of the bridge of FIG. 1.

The stiffness of the girders 22 and the manner in which they are attached to the decks is such that the two decks 10 and 11 act substantially as a single rigid body in regard to rotation in a transverse plane such as that of FIG. 2. The girders 22 in the present construction extend under the decks 10 and 11 and are attached to their lower sides.

With the construction described, flutter is almost entirely eliminated, regardless of the wind speed. This is because the bending and torsion modes of vibration have nominally the same frequency in still air as a result of the centre of inertia of each deck being directly below its supporting cables. Consequently the two modes cannot couple in winds.

Whereas in the structure described each deck has a pair of suspension cables, it is also possible to suspend each deck from its own single suspension cable, for example by using inclined hangers connecting the edges of the deck to the cable. The invention is equally effective in such a construction.

While the structure described is that of a suspension bridge with the deck hung from suspension cables, the invention is also applicable in cable-stayed structures and in structures where each deck is supported on one or more cables which are suspended in an arc below the deck.

I claim:

1. A long-span bridge, comprising spaced end supports; two spaced, parallel spans extending between and supported on said end supports, said spans being separated by an air gap and each said span having an elongate deck which is independently supported and which extends between said end supports and has a substantial width, each said span permitting said deck thereof to twist about its longitudinal axis, said air gap having a width greater than the width of each said deck; and stiff transverse beams extending between said spans at intervals therealong, said transverse beam coupling said decks so that they behave torsionally as a single, substantially rigid body.

2. A bridge according to claim 1, wherein each said span includes suspension cable means extending between said end supports, and hangers which support the associated deck from such suspension cable means.

3. A bridge according to claim 1, wherein each of said transverse beams has one end connected to one said deck and its other end connected to the other said deck.

4. A bridge according to claim 3, wherein each said transverse beam extends under each of said decks.

5. A bridge according to claim 1, wherein said beams extend sustantially perpendicularly between said decks, and including diagonal shear bracing extending between said transverse beams.

6. A bridge according to claim 1, wherein said width of said air gap is more than three times the width of said deck.

7. A suspension bridge, comprising spaced towers; two spaced, parallel spans extending between said towers, each said span including at least one suspension cable, an elongate deck extending between said towers and having a width, and plural hangers which support said deck from said suspension cable, each said span permitting said deck thereof to twist about its longitudinal axis, said spans being spaced by an air gap having a width greater than said width of each said deck; and stiff transverse beams which extend across said air gap, are provided at spaced intervals along said spans, and are connected to said decks so that said decks behave torsionally as a single, substantially rigid body.

8. A suspension bridge according to claim 7, wherein each of said transverse beams extends under each of said decks.

9. A suspension bridge according to claim 7, including diagonal shear bracing provided between each adjacent pair of said transverse beams.

10. A suspension bridge according to claim 7, wherein said width of said air gap is more than three times said width of each said deck.

11. A suspension bridge according to claim 7, wherein each said span includes two said suspension cables, and wherein each said tower includes two end towers, each said end tower supporting a respective one of said spans.

* * * * *

UNITED STATES PATENT AND TRADEMARK OFFICE

CERTIFICATE OF CORRECTION

PATENT NO. : 4 451 950

DATED : June 5, 1984

INVENTOR(S) : John Roy Richardson

It is certified that error appears in the above-identified patent and that said Letters Patent is hereby corrected as shown below:

Col. 3, line 27; change "beam" to ---beams---.

Signed and Sealed this

*Fifteenth* Day of *January 1985*

[SEAL]

*Attest:*

GERALD J. MOSSINGHOFF

*Attesting Officer*

*Commissioner of Patents and Trademarks*